United States Patent [19]

Wittingslow, Jr.

[11] Patent Number: 4,919,429

[45] Date of Patent: Apr. 24, 1990

[54] HAND SKILL AMUSEMENT GAME

[76] Inventor: Desmond T. Wittingslow, Jr., RSD 8602, Long Forest Road, Bacchus Marsh, Victoria 3340, Australia

[21] Appl. No.: 399,177

[22] Filed: Aug. 28, 1989

[51] Int. Cl.[5] ..... A63F 9/00

[52] U.S. Cl. ..... 273/1 GG

[58] Field of Search ..... 273/1 GG, 1 GE, 1 GF, 273/1 GC

[56] References Cited

U.S. PATENT DOCUMENTS

| | | | |
|---|---|---|---|
| 3,565,440 | 2/1971 | Glass et al. | 273/1 GG X |
| 3,583,701 | 6/1971 | Glass et al. | 273/1 GE |
| 3,612,527 | 10/1971 | Rogerson | 273/1 GF X |
| 3,784,197 | 1/1974 | Massicotte | 273/1 GE X |

*Primary Examiner*—Paul E. Shapiro

*Attorney, Agent, or Firm*—Cort Flint

[57] ABSTRACT

An amusement game device (A) is disclosed for testing the hand/eye coordination skill of a player. The amusement game includes a cabinet (10) having a playing compartment (22) with an open front (22*a*). An object (26) is extended and retracted through a raised floor (20) of cabinet (10) by a retraction mechanism (B). A releasable carrier (30) is attached to retracting mechanism (B). With retracting mechanism (B) in an extended position, object (26) may be manually grasped by hand (H) of the player. As soon as hand (H) is moved toward object (26) and pierces a light barrier between a light emitter (52) and receptor (54), a hand detection signal (36) is generated. A control unit (40) receives hand detection (36) and, after a predetermined time period, sends a control (41) to actuate retraction mechanism (B) and retract object (26). The person's skill is tested by whether or not the object (26) can be grasped and removed from the carrier platform (34) before the object disappears in floor (20).

15 Claims, 3 Drawing Sheets

HAND SKILL AMUSEMENT GAME

BACKGROUND OF THE INVENTION

The invention relates to an amusement game which involves hand/eye coordination and skill.

Electronic amusement games have enjoyed wide popularity over the last decade. Many of the games include a video display and a hand manipulated control such as buttons, handle, or knob controller by which the objectives of the game are achieved and displayed according to the skill of the player. This type of game involves hand/eye coordination but the player is relatively detached in a physical sense from achieving the objectives displayed on the video screen.

Accordingly, an object of the invention is to provide an amusement game which involves hand/eye coordination in which the player is physically involved in achieving the object of the game.

Another object of the invention is to provide an amusement game that provides hand/eye coordination in which the object is to manually grasp an object before it is removed from the player's grasp under uniform and random playing conditions.

Another object of the invention is to provide an amusement game in which the hand/eye coordination skill of a player is tested in accordance with the object of the game under various playing conditions.

SUMMARY OF THE INVENTION

The above objectives are accomplished according to the invention by providing a hand skill amusement game which includes an upstanding cabinet having a raised floor and an open front which gives access to the floor. An opening is formed in the floor through which an object is extended and retracted. The object is carried on platform of a retracting mechanism from which the object may be releasably grasped. A detector is carried near the open front of the cabinet which detects passage of the player's hand through the open front of the cabinet when moved toward the object. A hand detection signal is generated upon detecting the presence of the players hand which is sent to a time control circuit which activates the retraction mechanism to retract the object after a prescribed time interval upon receipt of the hand detection signal. If the player is able to move his hand quick enough, the object may be grasped and removed from the retracting platform prior to disappearance of the object. The retraction and extension of the object may be had in any prescribed manner, either uniform or random to test he hand/eye coordination of the player.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
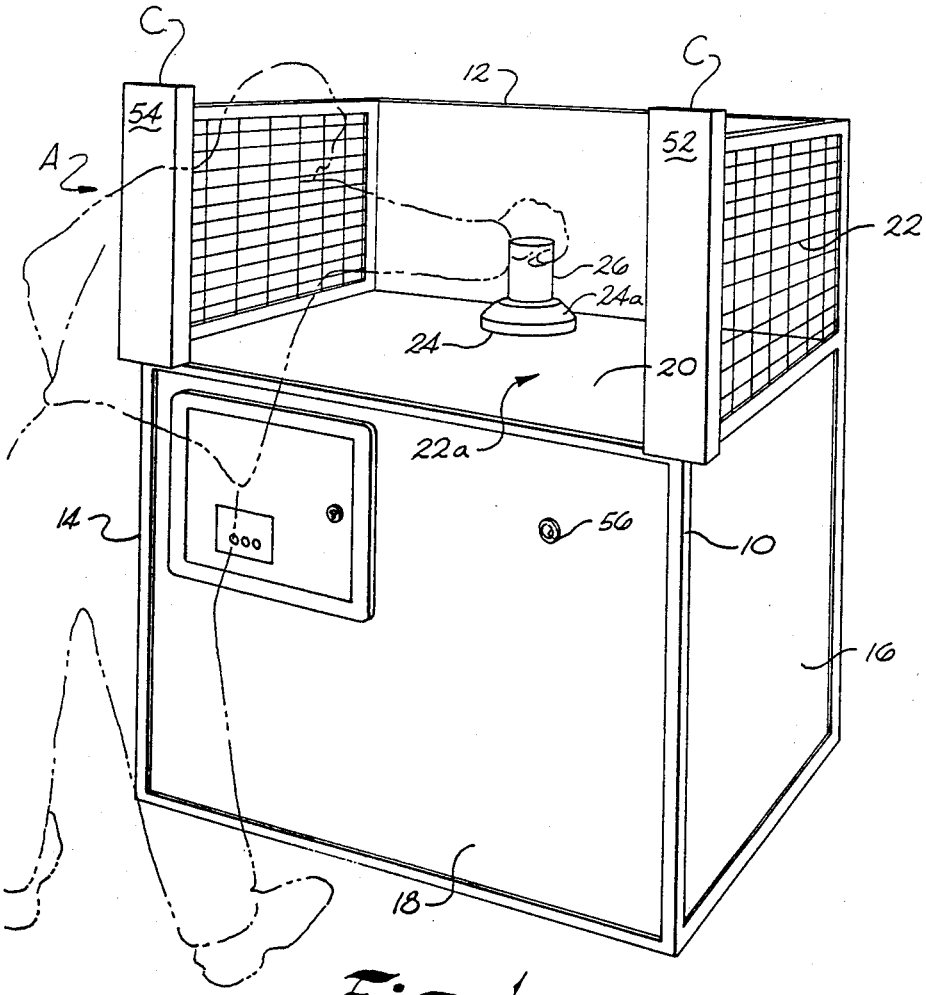
FIG. 1 is a perspective view illustrating a hand skill amusement game constructed in accordance with the present invention.
Figure 1A:
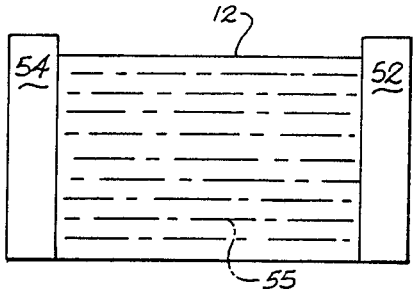
FIG. 1A is a front elevation illustrating a hand detecting light barrier according to the invention.
Figure 2:
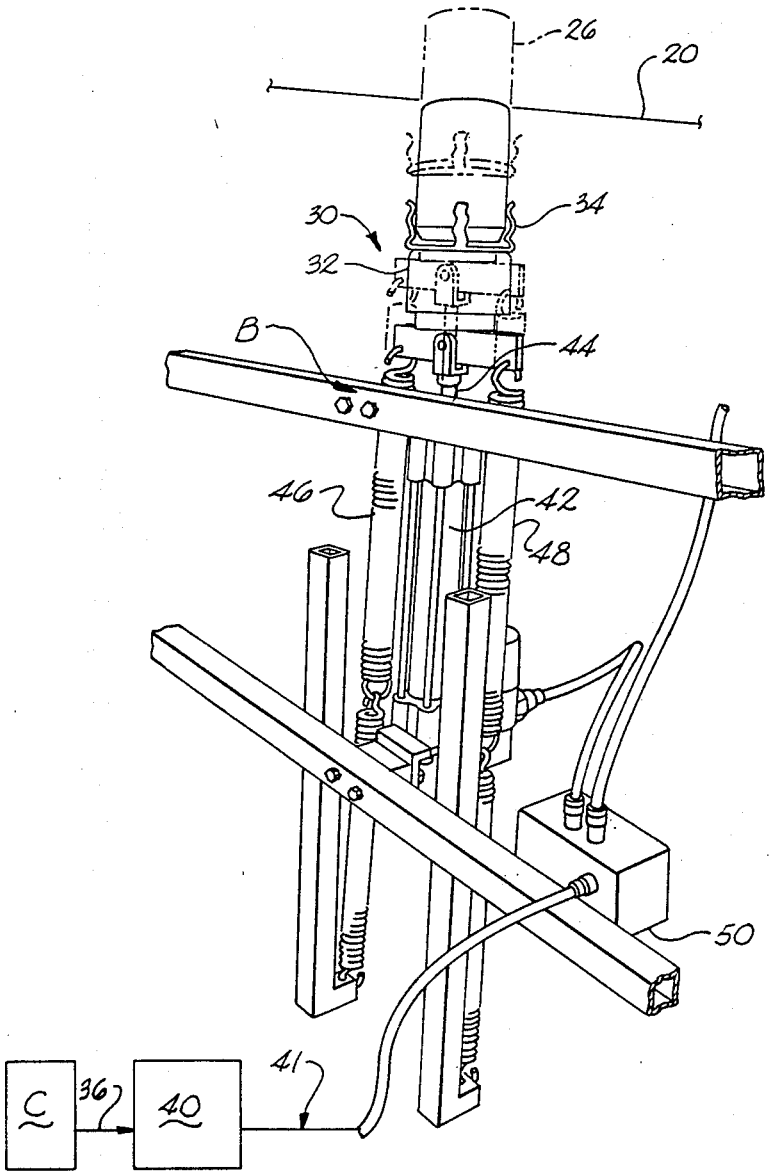
FIG. 2 is a view illustrating a retracting mechanism in a retracted and extended, dotted line positions for a game object according to the invention.

Referring now in more detail to the drawings, FIG. 1 illustrates an amusement game, designated generally as A which includes a upstanding cabinet 10 having a closed back side 12, a partially opened first side 14, and a partially opened second side 16, a partially closed front side 18, and a raised floor 20, all of which define a playing compartment 22 having an open front. The cabinet may be open or closed top, depending on the need. An opening 24 is included in raised floor 20 through which an object 26 is extended and retracted by a retracting means, designated generally as B. opening 24 has a collar **24*a* which surrounds the aperture in raised floor 20 in which the object the object is extended and retracted. Retracting means B includes a carrier means 30 which includes a platform 32 and a spring clamp 34 by which object 26 is releasably retained. In this manner, object 26 may be manually grasped by the players hand and removed from carrier platform 32. In the illustrated embodiment, object 26 is a soft drink container, but may be any other object used as a promotion. Retracting means B extends carrier 30 to a first, extended position, and retracts the carrier to a second, retracted position, as can best be seen in FIG. 2. Detector means C for detecting the position of a player's hand H is carried near front opening 22*a* of playing compartment 22 for generating a hand detection signal 36 in response to detecting the person's hand. A control unit 40 receives hand detection signal 36 and, after a prescribed time delay period, energizes retracting means B to retract object 26. The goal of the game is for the player to grasp object 26 with his hand before object 26** is retracted out of reach, and remove the object.

Figure 3:
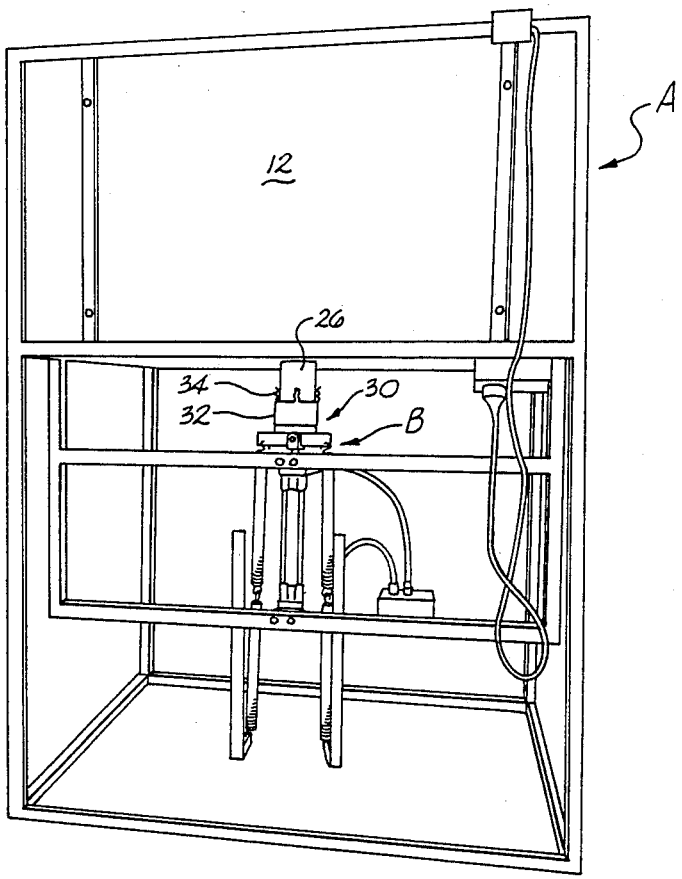
FIG. 3 is a rear view of a hand skill amusement game illustrating an extension/retraction mechanism for extending and retracting a game object according to the invention.

Referring now in more detail to retracting mechanism B, there is a air or other fluid cylinder 42 having a piston rod 44 on which carrier platform 32 is affixed, as can best be seen in FIG. 3. There is a first spring 46 on one side of cylinder 42 and a second spring 48 on the other side of cylinder 42 which are attached to a bar 43 fixed to platform 32. When retracting means B is extended by air cylinder means 42 being actuated, springs 46 and 48 are under substantial tension. As soon as control signal 41 is received by solenoid 50, air cylinder 52 is deactivated as air is vented from cylinder 42 and carrier 32 is retracted quickly under force of the springs 46 and 48.

Detector means C is preferably an electric eye having a plurality of photo cells arranged vertically in a column 52 and a plurality of detectors arranged in a column 54. In this manner, the entire front opening **22*a* of playing compartment 22 is covered with a light beam barrier 55 which, when broken by hand H, sends hand detection signal 36 to control circuit 40. The time delay in control circuit 40 may be varied by conventional means, for example, a reostat. Unit 40 may be programmed to provide a wide variety of programs for the extension and retraction of object 26. For example, the extension and retraction may be done at random time intervals as the player tries to grasp object 26. Alternately, a standard time delay can be had which gets longer after subsequent misses of object 26. Further, means may be provided in the control of the game for the player to select the difficulty level of the game so that he may choose his own time delay interval. There is a button 56 which, in one version of the game, may be operated to return object 26** to the extended position after it has been retracted and missed.

Accordingly, it can be seen that an advantageous construction for a hand skilled amusement game can be had wherein hand/eye coordination is tested according to various levels of skill. The players is directly and physically involved in the game by grasping an object after player's hand H has passed a barrier which triggers a retracting mechanism.

While a preferred embodiment of the invention has been described using specific terms, such description is for illustrative purposes only, and it is to be understood that changes and variations may be made without departing from the spirit or scope of the following claims.

What is claimed is:

1. An amusement game device for testing the skill of a person's eye/hand coordination comprising:

a game cabinet;

an object to be grasped by the hand of said person;

carrier means for releasably retaining said object in said game cabinet having a first position in which said object may be grasped and a second position in which said object is out of the reach of said person's hand;

retraction mean for moving said carrier means from said first position to said second position;

detection means for sensing the presence of said person's hand as it moves toward said object and generating a hand detection signal; and control means for controlling said retracting means in response to said hand detection signal for retracting said carrier means to said second position after the prescribed time period following generation of said hand detection signal.

2. The device of claim 1 wherein said detection means comprises a light barrier disposed between said object and said person through which said person's hand must pass for grasping of said object.

3. The device of claim 1 wherein said retraction means includes:

a fluid actuated cylinder;

a piston rod extending from said cylinder on which said carrier means is affixed; and actuating means for actuating said fluid cylinder for retracting and extending said carrier means and object.

4. The device of claim 3 wherein said actuary means comprises said fluid cylinder being a single action cylinder for moving said carrier means in a first direction, and means for biasing said carrier means in a direction opposite said first direction, wherein said carrier means is moved to one of said positions under fluid pressure and to the other of said positions under the force of said biasing means.

5. The device of claim 3 wherein said fluid cylinder comprises a single action cylinder which moves said carrier means to said first position, and including biasing means for moving said carrier means to said second position when said control signal is received.

6. The device of claim 1 wherein said carrier means comprises a platform having a releasable retainer for retaining said object allowing said object to be removed from said platform when grasped by said person's hand.

7. The device of claim 1 including a cabinet in which said floor is included, an aperture included in said floor in which said object is extended and retracted.

8. The device of claim 1 where said detector means includes a light barrier which is broken by said person's hand reaching for said object to generate said hand detection signal.

9. The device of claim 8 wherein said light barrier coextends across said front opening of said playing compartment.

10. An amusement game device for testing the skill of a person's eye/hand coordination comprising:

a cabinet having a back side, a left side, and a right side, and a front side defining a playing compartment with an open front for access to said playing compartment;

a raised floor carried within said closed cabinet;

an aperture formed in said raised floor through which an object is extended and retracted;

a cabinet having a floor;

carrier means for releasably retaining said object having a first position in which said object may be grasped and a second position in which said object is out of the reach of said person's hand;

retraction means for moving said carrier means from said first position to said second position;

detection means for sensing the presence of said person's hand as it moves toward said object and generating a hand detection signal; and control means for controlling said retracting means in response to said hand detection signal for retracting said carrier means to said second position after a prescribed time period following generation of said hand detection signal.

11. The device of claim 10 wherein said detection means comprises a light barrier disposed between said object and said person through which said person's hand must pass for grasping of said object.

12. The device of claim wherein said retraction means includes:

a fluid actuated cylinder;

a piston rod extending from said cylinders on which said carrier means is affixed; and actuating means for actuating said fluid cylinder for retracting and extending said carrier means and object.

13. The device of claim 12 wherein said fluid cylinder includes a single action cylinder wherein said carrier means is moved to one of said positions under fluid pressure and to the other of said positions under the force of said biasing means.

14. The device of claim 12 wherein said fluid cylinder comprises a single action cylinder which moves said carrier means to said first position, and including biasing means for moving said carrier means to said second position when said control signal is received.

15. The device of claim 10 wherein said carrier means comprises a platform having a releasable retainer for retaining said object while allowing said object to be removed from said platform when grasped by said person's hand.

* * * * *